US010961467B2

(12) United States Patent
Laanemets et al.

(10) Patent No.: US 10,961,467 B2
(45) Date of Patent: Mar. 30, 2021

(54) FUEL TREATMENT SYSTEM FOR AN ENGINE AND A METHOD USING THE SYSTEM

(71) Applicant: ALFA LAVAL CORPORATE AB, Lund (SE)

(72) Inventors: Karl Laanemets, Mölndal (SE); Jimmie Karlsson, Uttran (SE)

(73) Assignee: ALFA LAVAL CORPORATE AB, Lund (CH)

( * ) Notice: Subject to any disclaimer, the term of this patent is extended or adjusted under 35 U.S.C. 154(b) by 0 days.

(21) Appl. No.: 16/621,025

(22) PCT Filed: Jun. 28, 2018

(86) PCT No.: PCT/EP2018/067406
§ 371 (c)(1),
(2) Date: Dec. 10, 2019

(87) PCT Pub. No.: WO2019/002458
PCT Pub. Date: Jan. 3, 2019

(65) Prior Publication Data

US 2020/0263097 A1 Aug. 20, 2020

(30) Foreign Application Priority Data

Jun. 28, 2017 (EP) ..... 17178278

(51) Int. Cl.
*C10G 31/10* (2006.01)

(52) U.S. Cl.
CPC ..... *C10G 31/10* (2013.01); *C10L 2270/026* (2013.01); *C10L 2290/547* (2013.01); *C10L 2290/56* (2013.01)

(58) Field of Classification Search
None
See application file for complete search history.

(56) References Cited

U.S. PATENT DOCUMENTS

2006/0000767 A1 1/2006 Galasso, III et al.
2006/0105896 A1* 5/2006 Smith ..... B04B 1/2016 494/7

(Continued)

FOREIGN PATENT DOCUMENTS

DE 10 2012 112 026 A1 6/2014
EP 2 679 657 A1 1/2014

(Continued)

OTHER PUBLICATIONS

European Search Report, issued in Application No. 17 17 8278, dated Sep. 19, 2017.

(Continued)

*Primary Examiner* — Tam M Nguyen
(74) *Attorney, Agent, or Firm* — Birch, Stewart, Kolasch & Birch, LLP

(57) ABSTRACT

A fuel treatment system for an engine includes at least two centrifugal separators for cleaning fuel oil for an engine, at least two variable feed pumps for supplying fuel oil to be cleaned to the centrifugal separators, respectively, and at least two separator control units configured to control the operation of the centrifugal separators and the speed of the variable feed pumps, thereby controlling the flow rate of fuel oil to be cleaned to the separators. The system further includes a system control unit, other than the separator control units, configured for receiving information from a unit in the fuel treatment system that is arranged downstream of the centrifugal separators or from an engine arranged to use the fuel that is treated by the system, and for sending operational requests to the separator control units based on the received information.

20 Claims, 3 Drawing Sheets

(56) References Cited

U.S. PATENT DOCUMENTS

| | | | | |
|---|---|---|---|---|
| 2009/0105059 | A1* | 4/2009 | Dorry | B04B 1/2016 494/37 |
| 2015/0072850 | A1* | 3/2015 | Derrick | B04B 1/2016 494/8 |
| 2016/0122661 | A1* | 5/2016 | Mackel | C10G 31/10 208/177 |
| 2017/0014635 | A1 | 1/2017 | Peltokoski | |

FOREIGN PATENT DOCUMENTS

| | | | |
|---|---|---|---|
| GB | 744365 | | 2/1956 |
| JP | 61-149566 | A | 7/1986 |
| JP | 2-59057 | A | 2/1990 |
| JP | 4-69664 | U | 6/1992 |
| JP | 2015-113084 | A | 6/2015 |
| JP | 2015-522677 | A | 8/2015 |
| JP | 2016-509075 | A | 3/2016 |
| JP | 2017-509479 | A | 4/2017 |
| WO | WO 2007/045925 | A1 | 4/2007 |
| WO | WO 2015/150621 | A1 | 10/2015 |

OTHER PUBLICATIONS

International Search Report, issued in PCT/EP2018/067406, dated Aug. 14, 2018.
Written Opinion of the International Searching Authority, issued in PCT/EP2018/067406, dated Aug. 14, 2018.
English translation of the Japanese Office Action for Japanese Application No. 2019-572589, dated Jan. 12, 2021.

* cited by examiner

FUEL TREATMENT SYSTEM FOR AN ENGINE AND A METHOD USING THE SYSTEM

FIELD OF THE INVENTION

The present invention relates to the field of treating fuel oil, such as cleaning fuel oil on board a ship, and more specifically to the control of a fuel treatment system.

BACKGROUND OF THE INVENTION

Marine diesel engines usually accept several types of commercially available fuel oils as long as they are adequately treated on board the ship. Such a fuel treatment system usually comprises one or several centrifugal separators together with one or several settling tanks. Centrifugal separators are generally used for separation of liquids and/or solids from a liquid mixture, such as fuel oil. During operation, fuel oil that is to be treated is introduced into a rotating bowl and due to the centrifugal forces, heavy particles or denser liquid, such as water, accumulates at the periphery of the rotating bowl whereas a clean oil phase accumulates closer to the central axis of rotation. This allows for collection of the separated fractions, e.g. by means of different outlets arranged at the periphery and close to the rotational axis, respectively.

The requirements for handling fuel on board a ship today involve several operations and the treatment on board a ship is associated with several difficulties. For example, fuel oil for diesel engines on board ships and in power stations contains particles of silicon and aluminium compounds (e.g. microporous aluminium silicates or aluminosilicates known as zeolites), called catalyst fines. Catalyst fines are residues from the refining process of crude oil known as catalytic cracking, wherein long hydrocarbon molecules are cracked into shorter molecules. These particles are undesired in the fuel oil since they are abrasive and may cause wear in the engine and auxiliary equipment. Further, most ships run on residual fuel oil, or heavy fuel oil (HFO), which is essentially a refinery by-product that is blended to satisfy market demand for a relatively cheap source of energy. However, stricter regulations have been implemented to govern sulphur emissions from such residual oils with e.g. the introduction of Sulphur Emission Control Areas (SECAs) or Emission Control Areas (ECAs) sea areas. It is assumed that ships run on HFO outside ECAs and then switch to distillates as the ships enter ECAs. Differences in fuel properties and switching between different fuels thus make the preparation or treatment of the fuel oil on board a ship more complex.

A fuel treatment system on board a ship especially focuses on energy efficiency, fuel quality, environmental compliance and engine protection. There is a need in the art for a solution that optimizes the performance and control of the fuel treatment system on board a ship.

SUMMARY OF THE INVENTION

A main object of the present invention is to provide a fuel treatment system for an engine that allows for efficient use and control.

As a first aspect of the invention, there is provided a fuel treatment system for an engine comprising at least a first and a second centrifugal separator for cleaning fuel oil for an engine, at least a first and a second variable feed pump, wherein the first feed pump is arranged for supplying fuel oil to be cleaned to said first centrifugal separator and the second feed pump is arranged for supplying fuel oil to be cleaned to said second centrifugal separator, at least a first separator control unit configured to control the operation of the first centrifugal separator and the speed of the first variable feed pump, thereby controlling the flow rate of fuel oil to be cleaned to the first separator, a second separator control unit configured to control the operation of the second centrifugal separator and the speed of the second variable feed pump to control the flow rate of fuel oil to be cleaned to the second separator, a system control unit, other than the separator control units, configured for receiving information from a unit in the fuel treatment system that is arranged downstream of said centrifugal separator(s) or from an engine arranged to use the fuel that is treated by the system, and for sending operational requests to the separator control units based on said received information.

The fuel treatment system may be a system for on-board processing of the fuel oil, i.e. a system that is used on-board a ship. The engine may thus be a diesel engine, such as a diesel engine aboard a ship The term "fuel oil for an engine" refers herein to oil intended for use in an engine for the generation of power, such as in an engine on board a ship or in a power plant. The term "fuel oil" may be as defined in ISO 8217, Petroleum products—Fuels (class F)—Specification of marine fuels, editions 2005 and 2012, or an oil component/phase originating from the pre-treatment of such oil before use in an engine on board a ship or in a power plant. A fuel oil may be obtained as a fraction from petroleum distillation, either as a distillate or as a residue. Diesel is regarded as a fuel oil herein. The fuel oil may thus be marine (residual) fuel oil (MFO) or Bunker C oil.

The "fuel oil to be cleaned" may be composed of different types of fuel oils having different viscosities, generally stored in one or more tanks, which means that the type of fuel oil that is sent to the separator for cleaning may differ in time.

In embodiments, the fuel oil for a diesel engine comprises heavy fuel oil (HFO). HFO is a residue oil from distillation or from cracking in mineral oil processing.

The centrifugal separators may be arranged for separation of at least two components of a fluid mixture, such as a liquid mixture, which are of different densities.

Each centrifugal separator may comprise a stationary frame and a drive member configured to rotate a rotating part in relation to the stationary frame. The rotating part may comprise a spindle and a centrifuge rotor enclosing a separation space, the centrifuge rotor being mounted to the spindle to rotate together with the spindle around an axis (X) of rotation. The rotating part is supported by the stationary frame by at least one bearing device. The separation space may comprise a stack of separation discs arranged centrally around the axis of rotation. Such separation discs form surface enlarging inserts in the separation space. The separation discs may have the form of a truncated cone, i.e. the stack may be a stack of frustoconical separation discs. The discs may also be axial discs arranged around the axis of rotation.

A separator control unit is a unit that controls the operation of a separator and a feed pump. The feed pump may be controlled by the separator control unit by using of a variable frequency drive (VFD). The separator control unit may comprise a processor and an input/output interface for communicating with the separator and the feed pump air and for receiving information from the system control unit on how to operate the separator and feed pump.

The system control unit is a control unit other than the separator control units. The system control is a unit that sends operation requests to one or several separator control units. Thus, a separator control unit, as well as e.g. a VFD of a feed pump, is an independent system that may be fully functional in case the system control unit malfunctions.

The system control unit is further configured to receive information downstream of the centrifugal separators, such as from a unit in the fuel treatment system arranged downstream of one, both or all of the separators, or from an engine in which the oil cleaned or treated by the system is used. Downstream is thus somewhere in the fuel treatment system between the separator(s) and the engine. Based on the received information, operational requests are sent to the separator(s), i.e. instructions on system settings in the separator(s) during use. The system control unit may thus comprise computer program products configured for analysing said received information and send operational requests based on such analysis.

The fuel treatment system may of course also comprise transporting means, such as pipes or the like, between feed pump and separator, and between any other units in the system to or from which the fuel is transported.

The first aspect of the invention is based on the insight that controlling the flow rate through the separator or separators of a fuel treatment system has many advantages. For example, reduction of the flow through the separator(s) increases the retention time in the bowl. This leads to a higher separation efficiency, because smaller particles will have time to settle in the disc stack. In addition, increased energy efficiency will be achieved when the feed pumps, heaters and separators work at a lower load.

Further, as the fuel treatment system comprises several separators, the system control unit may have an overall control over the separator performance and send instructions that a separator should be turned off to increase energy efficiency, instead of having an operator turning each separator on and off. Moreover, having a system control unit and separator control units that are independent from each other, and having the separator control unit also controlling the fuel feed to the separators, then the separator control units may also function in case the overall system control unit malfunctions. Thus, if the system control unit breaks down, then the fuel feed to the separators may continue without disruption.

In embodiments of the first aspect of the invention, the operational request to the separator control unit comprises instructions on how to operate the at least first and second variable feed pumps and instructions on how to operate the at least first and second centrifugal separators.

Thus, the system control unit may send information to the separator control unit that also includes which feed rate is to be used for each separator.

In embodiments of the first aspect of the invention, the operational requests comprise at least one request selected from requesting a specific separator throughput, requesting start of the separator, requesting stop of the separator and requesting discharge of the separator.

The specific separator throughput may thus be information on the operational speed of the variable speed pump. The throughput may be sent as a percentage of the maximum capacity of the separator. The request for discharge of the separator may be a request for the separator to initiate a discharge sequence, in which a heavy phase accumulated at the outer periphery of the separation chamber is discharged, e.g. via intermittent opening of peripheral ports located at the periphery of the separator chamber. The centrifugal separators may thus be centrifugal separators having intermittent discharge systems, as known in the art.

In embodiments of the first aspect of the invention, the system control unit is further configured to receive return information from each separator control unit related to the operational status of each centrifugal separator.

As an example, the return information comprises information on the operational status of each separator, the maximum capacity of each separator, the current throughput of each separator, the temperature of each separator rotor and/or vibrations of each separator frame.

The operational status of the separators may comprise information if a separator is off or in standby, if it is in recirculation mode, start-up mode or production mode, if a discharge sequence is initiated or if the separator is shutting down.

Thus, the system control unit may also be aware of the actual operational status of several of the separators of the fuel treatment system in order to optimize fuel separation.

In embodiments of the first aspect of the invention, at least one unit in the fuel treatment system that is arranged downstream of said separator(s) comprises a tank to which the fuel treated by the at least first and second centrifugal separator is sent. Thus, in embodiments of the first aspect of the invention, the fuel treatment system further comprises at least one tank to which the fuel treated by the at least first and second centrifugal separator is sent. The tank to which the fuel treated by the at least first and second centrifugal separator may be a service tank from which the cleaned oil is transported to an engine. Information received by the system control unit from the service tank may comprise information of the fuel level in the tank, the density of the fuel, the temperature of the fuel and/or the viscosity of the fuel in the tank and the system control unit may then send requests to the separator control unit to adjust the flow through the separator, depending on the density, viscosity and required fuel temperature.

In embodiments of the first aspect of the invention, at least one unit in the fuel treatment system that is arranged downstream of said separator or separators comprises a fuel conditioning module which boosts the properties of the fuel in terms of temperature, viscosity and/or flow rate just prior to injection into the engine.

A fuel conditioning module is a module that boosts the properties of the fuel in terms of temperature, viscosity and/or flow rate just prior to injection into the engine.

The fuel conditioning module is thus for fuel conditioning before the fuel is supplied to the engine. Fuel conditioning is the treatment of fuel oil by a booster system to e.g. meet the cleanliness, pressure, temperature viscosity and flow rate specified by the engine manufacturers. The parameters managed by a fuel conditioning system are important for an engines combustion performance. The fuel conditioning module may also be arranged for handling different fuels, produce fuel blends and to manage automatic changeover between fuels.

The fuel conditioning module may comprise a flow meter arranged to measure the flow rate of cleaned oil that is entering an engine which uses the fuel oil cleaned by the system. A flow meter arranged for measuring the flow rate of fuel entering of the engine gives information about the fuel oil consumption of the engine, and may thus be used as a measure of the engine workload.

Consequently, the system control units may thus be configured to receive a signal from a fuel conditioning module or a flow meter at the engine what the fuel consumption is, and to match it with the throughput of the separator(s) of the fuel treatment system. The system control unit may also be configured to receive other information from the fuel conditioning module, such as densities, viscosity, sludge build up in fuel filters, fuel blend etc., based on information from sensors or control parameters of the FCM. The sludge build-up in filters can be determined through flow sensors, or pressure sensors arranged before, after and/or within the fuel filter(s), which may be comprised in the fuel conditional module, or as separate from the fuel conditioning module as separate unit(s) in the fuel treatment system. Also, the system control unit may also receive (at least) the fuel level from the service tank, to prevent the system from running out of fuel.

The at least one component in the fuel treatment system downstream of said separator may also be the actual engine in which the cleaned oil is used. Thus, the system control unit may be configured to send operational requests to the separator control unit(s) depending on the workload of the engine in which the cleaned oil phase is used. Thus, the operational requests may depend on information about the engine workload, such as the fuel consumption of the engine. If the workload of the engine and e.g. the fuel consumption of the engine decreases, the operational requests may comprise a request for reducing the flow rate of the fuel oil to be cleaned to one or more separators, and if the workload of the engine and e.g. the fuel consumption of the engine increases, the operational requests may comprise a request for increasing the flow rate of the fuel oil to be cleaned to one or more separators.

In embodiments of the first aspect of the invention, the system control unit is further configured for sending information to other units of the fuel treatment system, such as to a fuel conditioning module. The system control unit send information to the fuel conditioning module about the fuel properties, in order to optimize performance and to prevent blending of incompatible fuels.

Consequently, the fuel treatment system 1 of the present disclosure may match the throughput of the separators with the actual consumption of the engines and further introduce communication with a fuel conditioning module as well as taking more detailed information of the fuel in the tanks, such as density, viscosity and temperature, when sending operational requests to the centrifugal separators.

In embodiments of the first aspect of the invention, the system control unit further is configured to receive information from at least a unit in the fuel treatment system upstream of said at least first and second centrifugal separators and for sending operational requests to the separator control units based on said received information.

A component in the fuel treatment system upstream of the centrifugal separators is thus a unit arranged at a position such that the fuel oil meets the unit before the centrifugal separators. The unit may be a settling tank from which the variable feed pump supplies fuel to be treated to the separators. Thus, the system control unit may receive information about the properties of the fuel in a settling tank, for a more optimized fuel treatment operation. Consequently, the fuel treatment system may further comprise a bunker tank or the like for storing the fuel oil to be cleaned before being supplied to the centrifugal separators.

A unit in the fuel treatment system upstream of said at least first and second centrifugal separators may also comprise means for regulating the temperature of the fuel oil to be cleaned. Such means may comprise a heater and/or a heat exchanger The fuel treatment system may comprise more than two centrifugal separators, such as at least three or four centrifugal separators. These may be arranged or coupled in parallel to deliver clean oil to the same service tank. All centrifugal separators may have a separator control unit and a variable feed pump. However, a single feed pump may be used to deliver fuel oil to several separators, and the supply to each separator may be determined using a valve, such as a three-way valve, arranged between the feed pump and the separators. The system control unit may thus be configured to redirect the flow of fuel oil to be treated to other separators if one of the separators malfunction or is turned off.

As discussed above, since several separators are integrated in the same system, the system control unit functions as a coordinator to optimize the flow rate through the separators, and to match the total production with fuel consumption. The system control unit may be able to turn on and off separators to optimize the performance of the entire fuel treatment system.

In embodiments of the first aspect of the invention, the system control unit is configured for receiving and/or sending information to a unit for monitoring the amount of cat fines in the oil in the fuel treatment system.

Further, the system control unit may be configured to send requests to the separator control units based on the received information from such a unit for monitoring the amount of cat fines in the oil in the fuel treatment system.

Cat fines, or catalyst fines are residues from the refining process of crude oil known as catalytic cracking, wherein long hydrocarbon molecules are cracked into shorter molecules. These particles are undesired in the fuel oil since they are abrasive and may cause wear in the engine and auxiliary equipment. The concentration of catalyst fines in the fuel oil normally varies between 0 and 60 ppm. Catalyst fines may be in the size range from 0.1 microns (micrometres) to 100 microns.

The fuel treatment system may further comprise a sensor for measuring the concentration of catalyst fines in the clean oil phase and/or a sensor for measuring the concentration of catalyst fines in the fuel oil to be cleaned. The system control unit may thus be configured to send requests to the separator control units to regulate the flow rate of the fuel oil to be cleaned based on information from such a sensor or from several of such sensors. The system control unit may be configured to send requests to the separator control units to reduce the flow rate of the fuel oil to be cleaned if it receives information that the concentration of catalyst fines in the clean oil phase and/or the fuel oil to be cleaned increases, and it may be configured to send requests to increase the flow rate of the fuel oil to be cleaned if it receives information that the concentration of catalyst fines in the clean oil phase and/or the fuel oil to be cleaned decreases.

As an example, the system control unit could for example be configured to turn off a separator (if there is sufficient capacity in the remaining separators), if a high level of contaminants is detected in that separator's outlet (suggesting malfunction). It could also trigger a discharge of the separator(s).

In embodiments of the first aspect of the invention, the system control unit is configured for receiving and/or sending information to a unit on board a ship, said unit being arranged outside the fuel treatment system.

Thus, the system control unit may be configured to communicate with other applications on board a ship, such as a scrubber system for treating flue gases or a unit for detecting the seaway, such as a gyroscope. At high sea, the gyroscope could inform the system control unit about large roll motions. The system control unit could then trigger discharges of the separator at shorter intervals, or make sure that the separators are running on maximum separation efficiency.

As a second aspect of the invention, there is provided a method for treating fuel oil for an engine comprising the steps of:

- providing a fuel treatment system for an engine and a fuel oil to be cleaned;
- supplying said fuel oil to be cleaned to at least a first and a second centrifugal separator using at least a first and a second variable feed pump, respectively;
- cleaning said fuel oil in the centrifugal separators to provide a clean oil phase,
- controlling the operation of the centrifugal separators and the speed of the variable feed pumps using at least a first and a second separator control unit, respectively; and
- sending information from at least from a unit in the fuel treatment system downstream of said separators to the system control unit or from an engine arranged to use the fuel that is treated by the system, and
- sending operational requests to the separator control units based on said received information using said system control unit.

The terms and definitions used in relation to the second aspect are the same as discussed in relation to the first aspect above. Thus, the fuel treatment system for an engine may be a fuel treatment system of the first aspect of the invention above.

The step of supplying the fuel oil to be cleaned to centrifugal separators may comprise supplying the fuel oil to be cleaned to the separation space of the centrifugal separators, such as via an inlet pipe leading to the separation space, from e.g. a tank for storing the fuel oil The step of cleaning the fuel oil in the centrifugal separator to provide a clean oil phase may comprise separating the fuel oil to be cleaned into a clean oil phase, a sludge phase and an aqueous phase. The sludge phase may comprise solid impurities, such as catalyst fines (cat fines).

The method may further include the step of adding a separation aid to the fuel oil to be cleaned, i.e. upstream of a separator. Such separation aid may be a liquid separation aid, such as a polymer. Consequently, the step of cleaning may comprise separating in the separation space of a centrifugal separator the catalyst fines and the separation aid from the fuel oil by centrifugal force; discharging a clean oil phase from the separation space through a central light phase outlet thereof; and discharging separated smaller particle, such as catalyst fines, together with separated separation aid from the separation chamber through a heavy phase outlet of the separation chamber, situated radially outside the central light phase outlet.

In embodiments of the second aspect of the invention, the method is further comprising a step of regulating the temperature of the fuel oil to be cleaned. This may comprise changing the temperature, such as heating the oil, so that the viscosity of the oil to be cleaned is kept below a specific maximum viscosity $v_{max}$. The viscosity measured may be the viscosity of the fuel oil upstream of the separators, such as between a fuel oil tank and one or more of the separators. The viscosity may also be measured e.g. downstream of a heater for heating the oil, i.e. after heating of the oil. This means that the temperature may be regulated based on the oil that is about to be separated. However, the viscosity could also be measured of the oil that has been cleaned. The viscosity could for example be measured at or after the liquid light phase outlet of the separator or in a tank downstream of the separator before the cleaned fuel oil is used in the engine.

The step of regulating the temperature may comprise regulating the temperature to temperatures above 98° C. As an example, the temperature of the fuel oil to be cleaned may be regulated to temperatures that include temperatures above 105° C., such as above 110° C., such as above 115° C.

In embodiments of the second aspect of the invention, the method is further comprising sending return information from said separator control units related to the operational status of the centrifugal separators to said system control unit.

In embodiments of the second aspect of the invention, the method is further comprising sending information from at least a unit in the fuel treatment system upstream of at least one of said centrifugal separators and wherein the operational requests to the separator control unit are further based on said received information.

As a third aspect of the invention, there is provided a method for controlling a process for treating fuel oil for a diesel engine comprising the steps of:

- receiving information at least from a unit in a fuel treatment system that is downstream of at least one separator for cleaning said fuel oil,
- sending operational requests to at least two separator control units based on said received information, said operational request comprising instructions on how to operate at least two variable feed pumps for supplying fuel oil to be cleaned to said centrifugal separators and instructions on how to operate the centrifugal separators.

The terms and definitions used in relation to the third aspect are the same as discussed in relation to the other aspects above.

The method of the third aspect may be performed by a system control unit as discussed in relation to the first aspect above.

Thus, as a further aspect of the invention, there is provided a computer program product, comprising program code instructions for executing the method according of the third aspect of the invention, when said program is executed by a computer. As an example, the system control unit may comprise such a computer program product.

Further, as further aspect of the invention, there is provided a computer-readable storage medium on which is saved a computer program comprising program code instructions for executing the method according to the third aspect of the invention, when said program is executed by a computer.

In embodiments of the third aspect of the invention, the method, further comprising receiving information from at least one unit in the fuel treatment system upstream of said separators and wherein the operational requests sent to said separator control units are also based on such received information.

Further, in an aspect of the present invention, there is provided a computer program product comprising computer-executable components for causing a device to perform the steps of the method according to the third aspect of the invention, when the computer-executable components are run on a processing unit included in the device. The device may thus be a system control unit.

DETAILED DESCRIPTION

The method and the system according to the present disclosure will be further illustrated by the following description with reference to the accompanying drawings. For ease of description and facilitating understanding, although the invention relates to a fuel treatment system comprising a plurality of centrifugal separators, description is first made with reference to FIG. 1 of a fuel treatment system comprising a single centrifugal separator. The various system components and their functions are the same for a single separator and a plural separator system, except as required adaptation to a plural centrifugal separator fuel treatment system, e.g. the control unit receiving information and sending operational request to two or more separators instead of one. Thus, the features, functions and configurations described with reference to FIG. 1 for a first separator, a first variable feed pump and a first separator control unit, etc., are the same as for a second separator, a second variable feed pump, a second separator control unit, etc.

Figure 1:
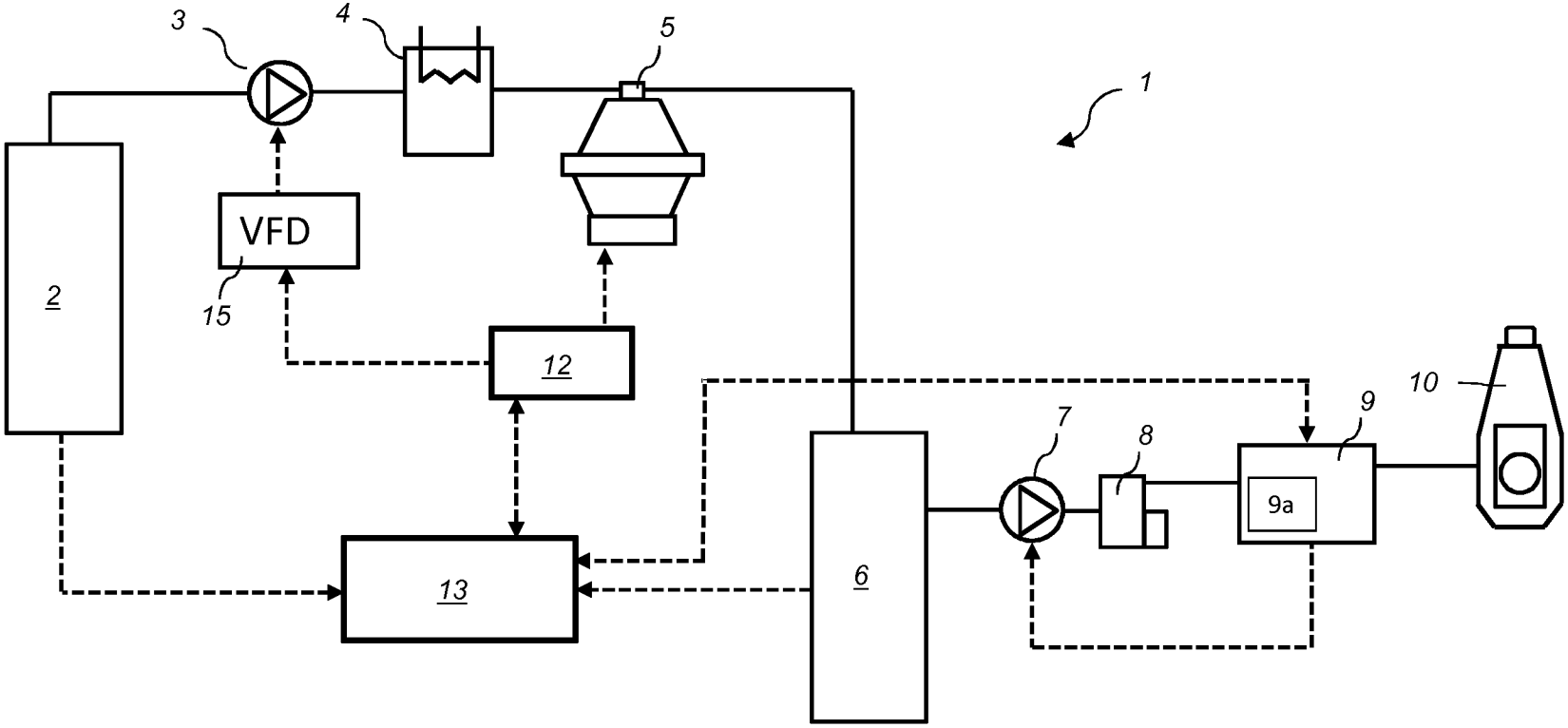
FIG. 1 shows a schematic drawing of an embodiment of a system comprising one centrifugal separator.

FIG. 1 shows a schematic drawing of an embodiment of a fuel treatment system 1 consisting of a settling tank 2, a first feed pump 3, pre-heater 4, separator 5, service tank 6, an additional feed pump 7, a fuel conditioning module (FCM) 9 and one engine 10.

Fuel for the engine in bunkered in settling tank 2. This fuel may be heavy fuel oil (HFO) or any other fuel suitable for a diesel engine. The tank 2 may have a slanted tank bottom that facilitates the collection and removal of cat fines and prevent them from being stirred up in rough weather. Fuel oil to be cleaned is supplied to a centrifugal separator 5 by means of variable feed pump 3. The system further comprises a pre-heater 4 for regulating the temperature of the fuel oil to be cleaned. The fuel oil is in this embodiment initially heated to about 98° C. by heater 4. The centrifugal separator 5 is of a kind known in the art for cleaning fuel oil on board a ship. The separator 5 may thus comprise a rotor that forms within itself a separation chamber in which centrifugal separation of the fuel oil takes place during operation. The separation chamber is provided with a stack of frusto-conical separation discs to facilitate effective separation of the fuel oil. The stack of truncated conical separation discs are examples of surface-enlarging inserts and are fitted centrally and coaxially with the rotor. During operation of the separator 5, fuel oil to be separated is brought into the separation space. Depending on the density, different phases in the fuel oil is separated between the separation discs 1. Heavier component, such as a water phase and a sludge phase, move radially outwards between the separation discs, whereas the phase of lowest density, such as the clean oil phase, moves radially inwards between the separation discs and is forced through an outlet arranged at the radial innermost level in the separator. The liquid of higher density is instead forced out through an outlet that is at a larger radial distance. Solids, or sludge, accumulate at the periphery of the separation chamber and is emptied intermittently from the separation space by a set of radially sludge outlets being opened, whereupon sludge and a certain amount of fluid is discharged from the separation space by means of centrifugal force.

The clean oil phase is brought to service tank 6. When needed by the engine 10, oil is transferred from the service tank using variable speed pump 7 through oil filter 8. This may be an automatic filter positioned before fuel conditioning module 9 to capture and remove particles and impurities before they can enter the engine 10.

The fuel conditioning module 9, or booster system, optimizes the properties of the fuel oil before it is injected to engine 10 in terms of cleanliness, pressure, temperature, viscosity and flow rate depending on the specification of the engine's combustion performance. This further increase energy efficiency and reduces emissions. As a part of the FCM 9, a fuel changeover system (ACS) 9*a* may be used. The ACS 9*a* is for maintaining the right fuel parameters at injection to the engine 10 at fuel changeover, i.e. when switching from a first fuel such as HFO to a distillate fuel. Since the injection temperature of distillate fuel is much lower than that of HFO, thermal shocks may arise in the injection system. An ACS manages fuel changeover e.g. by controlling temperature gradient inside the injection system and maintains the correct temperature and viscosity of the fuel at injection to engine 10. Further, the fuel conditioning module 9 also controls the flow rate of cleaned fuel oil from service tank 6.

The first feed pump 3 is regulated by a VFD 15 which is controlled by the separator control unit 12. The separator control unit 12 further controls the operation of the separator 5, e.g. when the separator is turned on and off, and thus also the flow rate of fuel oil from settling tank 2 to separator 5.

For this purpose the system control unit 13 and/or the separator control unit 12 may comprise a communication interface, such as a transmitter/receiver, via which it may receive and transmit data. The system control unit 13 and/or the separator control unit 12 may comprise a processing unit, such as a central processing unit, which is configured to execute computer code instructions which for instance may be stored on a memory. The memory may thus form a (non-transitory) computer-readable medium for storing such computer code instructions. The processing unit may alternatively be in the form of a hardware unit, such as an application specific integrated circuit, a field-programmable gate array or the like.

In this embodiment, in order to execute the requests sent by the system control unit 13, the separator control unit 12 is configured to receive an analog signal (4-20 mA or through Ethernet) which tells the separator control unit 12 which speed the feed pump 3 should run on, such as in the range 25-100% of the maximum capacity. The separator control unit 12 is further configured to receive a request signal for discharge and a request signal to turn on/off the separator, or rather, put it in standby.

The separator control unit 12 is further configured to send information to the system control unit 13, such as a status signal, i.e. if the separator 5 is in production or not. The separator 5 could be closed due to discharge, or in start-up or recirculation. Further information sent from separator control unit 5 to system control unit 13 may include the separators maximum throughput capacity, its current throughput (estimated from pump curve, or measured) and temperature, vibration and other sensor data that the separator is equipped with.

The system control unit 13, independent from the separator control unit 12, communicates with the separator control unit 12 and also the FCM 9, and collects information from the tanks 2 and 3, as indicated by the dotted lines in FIG. 1. In this embodiment, the system control 13 unit is configured to receive information about the fuel in the service or day tank 6, such as density, viscosity and temperature of the fuel in tank 6. This information may be used by the system control unit 13 to determine compatibility between different fuels.

The system control unit 13 is further configured to receive information from the FCM 9, such as the actual flow rate to the engine 10, information about fuel changeover, requests to the system control unit 13 to process another fuel. The FCM 9 may also inform the system control unit 13 about time until fuel will be taken out of operation and other readings from sensors and units in the FCM 9, e.g. sludge build-up in filters, temperatures, densities, etc.

During operation of the engine 10, the fuel consumption of the engine 10 is measured by a flow meter (not shown) at the FCM 9. This information is sent to the system control unit 13. System control unit 13 sends a requested throughput to the separator control unit 12, which will then regulate the speed of the feed pump 3 via the VFD. By lowering the flow through the separator 5, the separation efficiency will increase. The energy consumption of the feed pump 3 will be reduced, as will the heat demand of the pre-heater 4.

Further, the fuel level in the service tank 6 is be monitored by the system control unit 13. If, for some reason, the level drops below a lower-limit, the system control 13 may trigger an alarm and request 100% throughput of the separator 5. When the alarm has been acknowledged and the reason of the alarm fixed, the flow control of the separator 5 can be started again.

The tanks 2 and 6 could also be equipped with other types of sensors so that temperature, density, viscosity, sulphur level etc. could be measured and information sent to the system control unit 13. The sensors could be installed in both the day tank 6 and the settling tank 2. The separator 5 could then be requested by the system control unit 13 operate in different ways if it cleans a low density/viscosity distillate or a sluggish heavy fuel oil. The booster, i.e. the FCM 9, may treat the fuel in different ways depending on its properties.

Figure 2:
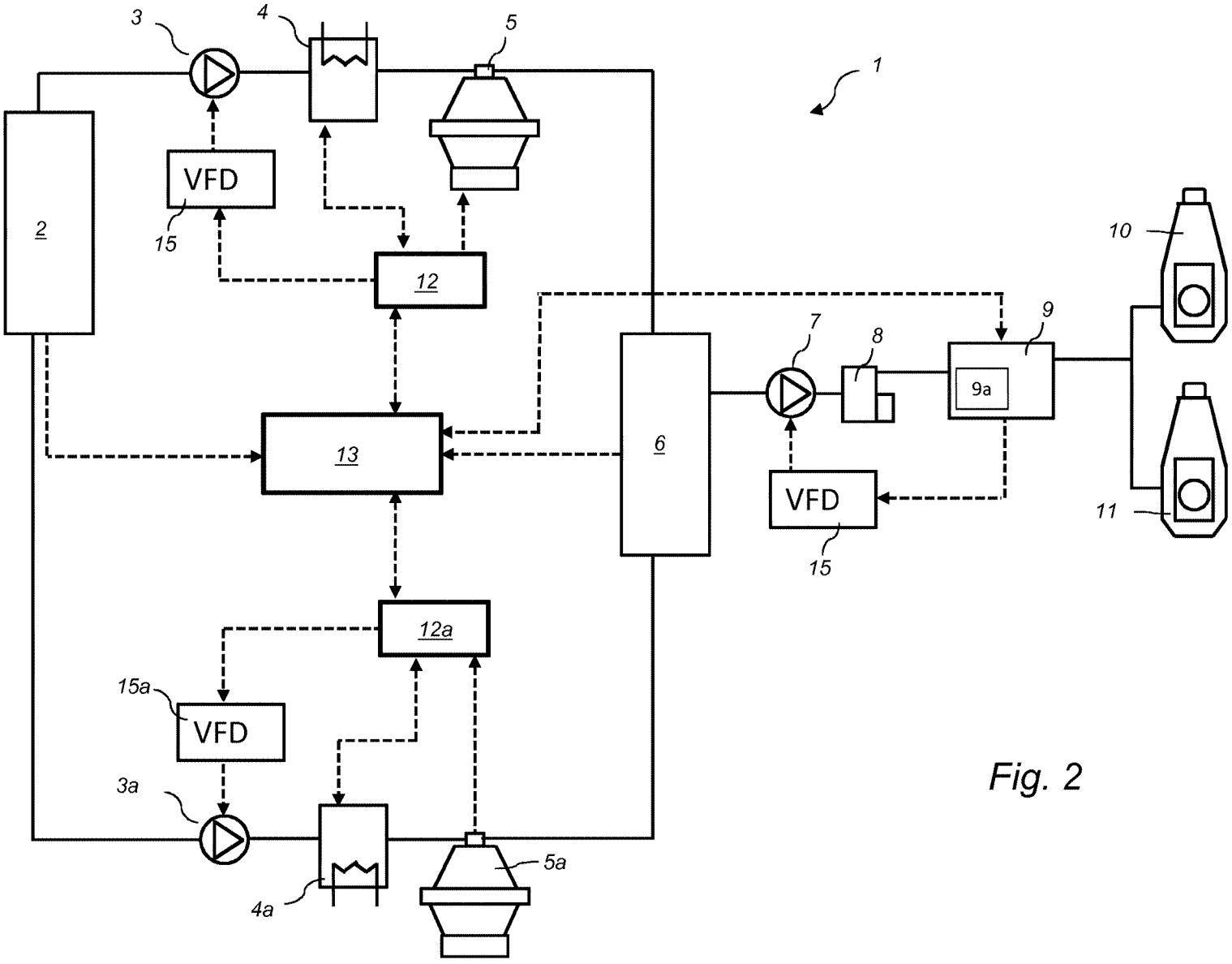
FIG. 2 shows a schematic drawing of a further embodiment of a system comprising two separators.

FIG. 2 shows a further embodiment of a fuel treatment system 1 on board a ship. The system 1 and the units of the system function as discussed for the system in FIG. 1 above, but the system 1 in FIG. 2 comprises a second separator 5*a* for cleaning the oil in the settling tank 2. For this purpose, there is a second feed pump 3*a* is regulated by a VFD 15*a* that is controlled by a second separator control unit 12*a*. The operation of the separator 5*a* is controlled by the separator control unit 12*a* in similar ways as the first separator control unit 5 controls the first separator 5. The fuel cleaned by both separators 5 and 5*a* are sent to the same service tank 6.

In the system of FIG. 2, there is also an auxiliary engine 11 to which the cleaned fuel oil may be directed by the FCM 9. Further, in this example, the fuel conditioning module 9 controls the flow rate of cleaned fuel oil from service tank 6 by means of a Variable Frequency Drive 15 connected to the variable feed pump 7.

When a second separator 5*a* is added to the system 1, as illustrated in FIG. 2, the system control unit 13 may coordinate the flow through the separators 5 and 5*a* to match the total consumption of the engines 10 and 11. When the consumption goes below an efficiency breakpoint, the system control unit 13 may request that one off the separators is turned off. When the fuel consumption increases above the efficiency breakpoint, the other separator will be requested to start up again. The efficiency breakpoint may be pre-set manually by an operator.

Further, in the system shown in FIG. 2, the first separator control unit 12 also controls the pre-heater 4 for heating the oil supplied to the first separator 5 and the second separator control unit 12*a* also controls the pre-heater 4*a* for heating the oil supplied to the second separator 5*a*. Thus, the system control unit 13 may send operational requests to the separator control units to change the temperature and therefore the viscosity of the fuel oil to be cleaned based on information from e.g. the service tank 6 or the FCM 9.

The system 1 may comprise further centrifugal separators, such as three or more separators, which are all controlled by separator control units, and the system control unit 13 may thus be configured to send requests to all separators in the fuel treatment system 1.

Figure 3:
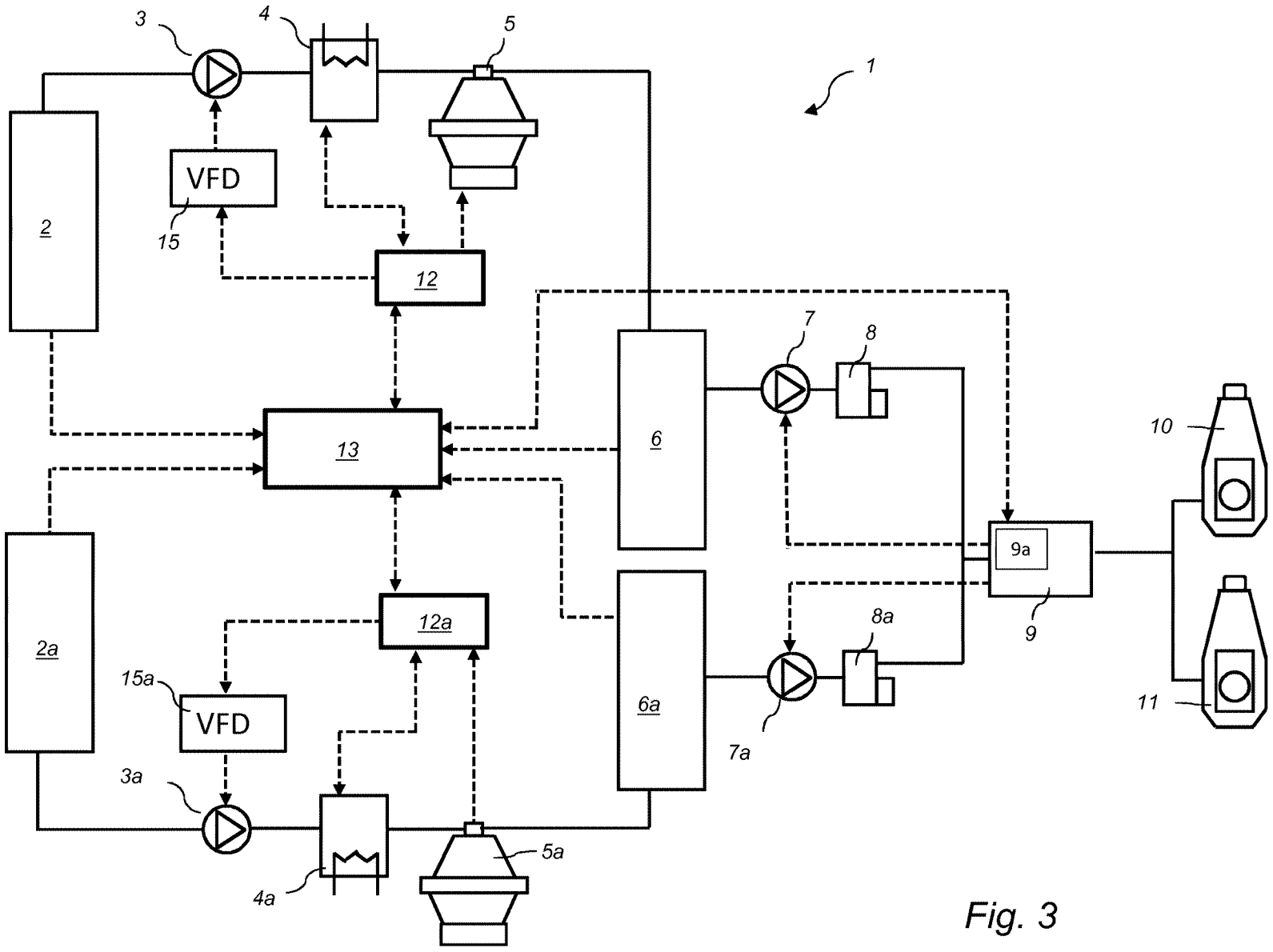
FIG. 3 shows a schematic drawing of a further embodiment of a system comprising two separators and also two settling tanks.

FIG. 3 shows a further embodiment of a fuel treatment system 1 on board a ship. The system 1 and the units of the system function as discussed for the system in FIG. 2 above, but the system 1 in FIG. 3 contains a first tank 2 as well as a second settling tank 2*a* having a different type of fuel than settling tank 2. For example, settling tank 2 may contain HFO whereas settling tank 2*a* may contain a distillate fuel, or the tanks 2 and 2*a* may have different types of distillate fuels.

The oil cleaned by the separators 5 and 5*a* are sent to two different service tanks 6 and 6*a*, and the FCM 9 may control which fuel and how much fuel is to be supplied from each tank. This is performed by using feed pump 7 for supplying cleaned oil from tank 6 and by using feed pump 7*a* for supplying cleaned oil from tank 6*a*. Information on the supply of oil from each tank 6 and 6*a* may be sent by the system control unit 13.

Further, as discussed in relation to FIG. 1 above, information of the fuel properties of the bunkered fuels in the settling tank 2 and 2*a* may be measured by sensors on board and be sent to the system control unit 13. As an alternative, information of the fuel properties may be inserted in the software of the system control unit 13 manually when bunkering. The relevant fuel properties will thus be assigned to each settling tank 2 and 2*a*. The system control unit 13 may then calculate the blended properties of the fuels in the settling tanks 2 and 2*a* and send such information to the FCM 9, or if the cleaned fuels from both tanks 2 and 2*a* are sent to the same service tank, i.e. if there were only a single service tank 6 in the system of FIG. 3, then the system control unit 13 may calculate the actual fuel property of the blend in such a single service tanks.

Information of the fuel property of a blended fuel may comprise information of sulphur levels, since these are of interest regarding emission regulation in Sulphur Emission Control Areas (SECAs) or Emission Control Areas (ECAs) sea areas.

Also, the fuel properties could be of interest in compatibility evaluations of the FCM. If statistical data on the incompatibility of fuels is gathered by the system control unit 13, the FCM could avoid those blends in a fuel switch.

Furthermore, whereas FIGS. 2 and 3 illustrate embodiments of fuel treatment systems arranged for treating fuel to be provided for two engines, the fuel treatment systems illustrated in FIGS. 2 and 3 are also applicable for one engine, or for more than two engines.

The invention is not limited to the embodiment disclosed but may be varied and modified within the scope of the claims set out below. The invention is not limited to the type of separator as shown in the FIGS. The term "centrifugal separator" also comprises centrifugal separators with a substantially horizontally oriented axis of rotation and separator having a single liquid outlet.

The invention claimed is:

1. A fuel treatment system for an engine comprising:

at least a first and a second centrifugal separator for cleaning fuel oil for an engine;

at least a first and a second variable feed pump, wherein the first feed pump is arranged for supplying fuel oil to be cleaned to said first centrifugal separator and the second feed pump is arranged for supplying fuel oil to be cleaned to said second centrifugal separator;

a first separator control unit configured to control the operation of the first centrifugal separator and the speed of the first variable feed pump to control the flow rate of fuel oil to be cleaned to the first, centrifugal separator;

a second separator control unit configured to control the operation of the second centrifugal separator and the speed of the second variable feed pump to control the flow rate of fuel oil to be cleaned to the second, centrifugal separator; and a system control unit, other than the first and second separator control units, configured for receiving information from a unit in the fuel treatment system that is arranged downstream of said centrifugal separators, or from an engine arranged to use the fuel that is treated by the fuel treatment system, and for sending operational requests to the first and second separator control units based on said received information.

2. The fuel treatment system according to claim 1, wherein the operational requests to the separator control units comprise instructions on how to operate said first and second variable feed pumps and instructions on how to operate said centrifugal separators.

3. The fuel treatment system according to claim 1, wherein the operational requests comprise at least one request selected from requesting a specific separator throughput, requesting start of at least one of said centrifugal separators, requesting stop of at least one of said centrifugal separators or requesting discharge of at least one of said centrifugal separators.

4. The fuel treatment system according to claim 1, wherein the system control unit is further configured to receive return information from said first and second separator control units related to the operational status of the centrifugal separators.

5. The fuel treatment system according to claim 4, wherein said return information comprises information on the operational status of the centrifugal separators, the maximum capacity of centrifugal separators, the current throughput of the centrifugal separators, the temperature of the separator rotor and/or vibrations of the separator frame of each of said centrifugal separators.

6. The fuel treatment system according to claim 1, wherein at least one unit in the fuel treatment system that is arranged downstream of one or more of said centrifugal separators comprises a tank to which the fuel treated by at least one of the centrifugal separators is sent.

7. The fuel treatment system according to claim 1, wherein at least one unit in the fuel treatment system that is arranged downstream of said centrifugal separators comprises a fuel conditioning module arranged to boost the properties of the fuel in terms of temperature, viscosity and/or flow rate just prior to injection into the engine.

8. The fuel treatment system according to claim 1, wherein the system control unit is further configured to receive information from at least a unit in the fuel treatment system upstream at least one of said centrifugal separators and for sending operational requests to the separator control units based on said received information.

9. The fuel treatment system according to claim 1, wherein said engine is located on a ship for propulsion of the ship.

10. The fuel treatment system according to claim 1, wherein said information is the fuel consumption of the engine, said fuel consumption is an actual fuel consumption measured with a flow meter, or said fuel consumption is an assumed fuel consumption based on a set value.

11. A method for treating fuel oil for an engine comprising the steps of:

providing a fuel treatment system for an engine and a fuel oil to be cleaned;

supplying said fuel oil to be cleaned to at least a first and a second centrifugal separator using at least a first and a second variable feed pump, respectively;

cleaning said fuel oil in the centrifugal separators to provide a clean oil phase;

controlling the operation of the centrifugal separators and the speed of the variable feed pumps using at least a first and a second separator control unit, respectively; and sending information from at least one unit in the fuel treatment system downstream of said centrifugal separators to a system control unit or from an engine arranged to use the fuel that is treated by the system; and sending operational requests to the separator control units based on said received information using said system control unit.

12. The method according to claim 11, further comprising sending return information from said separator control units related to the operational status of the centrifugal separators to said system control unit.

13. The method according to claim 11, further comprising sending information from at least a unit in the fuel treatment system upstream of said centrifugal separators, and wherein the operational requests to the separator control units are further based on said received information.

14. A method for controlling a process for treating fuel oil for a diesel engine comprising the steps of:

receiving information at least from a unit in a fuel treatment system that is downstream of at least one separator for cleaning said fuel oil;

sending operational requests to at least two separator control units based on said received information, said operational request comprising instructions on how to operate at least two variable feed pumps for supplying fuel oil to be cleaned to at least two centrifugal separators and instructions on how to operate the centrifugal separators.

15. The method according to claim 14, further comprising receiving information from at least a unit in the fuel treatment system upstream of said centrifugal separators and wherein the operational requests sent to said separator control units are also based on such received information.

16. The fuel treatment system according to claim 2, wherein the operational requests comprise at least one request selected from requesting a specific separator throughput, requesting start of at least one of said centrifugal separators, requesting stop of at least one of said centrifugal separators or requesting discharge of at least one of said centrifugal separators.

17. The fuel treatment system according to claim 2, wherein the system control unit is further configured to receive return information from said separator control units related to the operational status of the centrifugal separators.

18. The fuel treatment system according to claim 3, wherein the system control unit is further configured to receive return information from said separator control units related to the operational status of the centrifugal separators.

19. The fuel treatment system according to claim 2, wherein at least one unit in the fuel treatment system that is arranged downstream of one or more of said centrifugal separators comprises a tank to which the fuel treated by at least one of the centrifugal separators is sent.

20. The fuel treatment system according to claim 3, wherein at least one unit in the fuel treatment system that is arranged downstream of one or more of said centrifugal separators comprises a tank to which the fuel treated by at least one of the centrifugal separators is sent.

* * * * *